US010570523B2

(12) United States Patent
Whitmore

(10) Patent No.: US 10,570,523 B2
(45) Date of Patent: Feb. 25, 2020

(54) MANUFACTURE OF SACRIFICIAL ANODES

(71) Applicant: David William Whitmore, Winnipeg (CA)

(72) Inventor: David William Whitmore, Winnipeg (CA)

( * ) Notice: Subject to any disclaimer, the term of this patent is extended or adjusted under 35 U.S.C. 154(b) by 207 days.

(21) Appl. No.: 15/686,858

(22) Filed: Aug. 25, 2017

(65) Prior Publication Data

US 2019/0062927 A1 Feb. 28, 2019

(51) Int. Cl.

| | |
|---|---|
| ***C23F 13/08*** | (2006.01) |
| ***C23F 13/14*** | (2006.01) |
| ***C23F 13/02*** | (2006.01) |
| ***C23F 13/10*** | (2006.01) |
| ***C23F 13/16*** | (2006.01) |
| ***C23F 13/18*** | (2006.01) |
| ***C23F 13/20*** | (2006.01) |

(52) U.S. Cl.

CPC ..... *C23F 13/14* (2013.01); *C23F 13/02* (2013.01); *C23F 13/10* (2013.01); *C23F 13/16* (2013.01); *C23F 13/18* (2013.01); *C23F 13/20* (2013.01); *C23F 2201/02* (2013.01); *C23F 2213/22* (2013.01)

(58) Field of Classification Search

CPC ..... C23F 13/02; C23F 13/06; C23F 13/08; C23F 13/10; C23F 13/16; C23F 13/18; C23F 2201/02; C23F 2213/22; B65D 35/00; B65D 35/22; B65D 69/00; B65D 71/00–71/10; B65D 81/00; B65D 85/00; B65D 85/20; B65D 85/26; B65D 85/62

See application file for complete search history.

(56) References Cited

U.S. PATENT DOCUMENTS

| | | | | |
|---|---|---|---|---|
| 2,621,154 A * | 12/1952 | Mears | C23F 13/02 204/196.15 |
| 3,638,790 A * | 2/1972 | Schmid | B65D 71/0096 206/446 |
| 2015/0068919 A1* | 3/2015 | Burns | C23F 13/12 205/724 |

* cited by examiner

*Primary Examiner* — Alexander W Keeling
(74) *Attorney, Agent, or Firm* — Adrian D. Battison; Ade & Company Inc; Michael R. Williams

(57) ABSTRACT

Sacrificial anodes for installing in an ionically conductive medium at an installation site containing metal requiring cathodic protection are formed by locating anode cores in a tray having dividing members defining a row of side by side chambers with each chamber containing a respective one of the anode cores and casting into the receptacle a covering mortar for the anode cores with each anode core receiving a coating at least partly surrounding the anode core with the connecting wire exposed. The mortar is cast to form frangible bridges between each anode and the next. The trays are stacked and transported to the site where the installer separates and individually installs the anodes into the medium.

37 Claims, 5 Drawing Sheets

FIG. 5
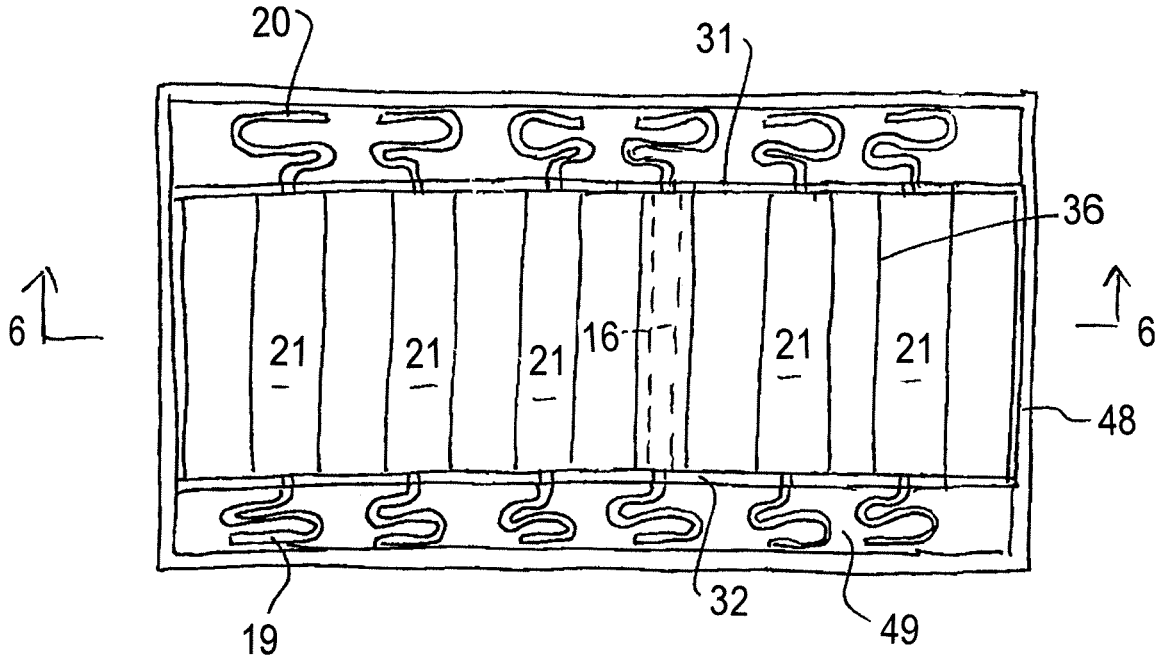
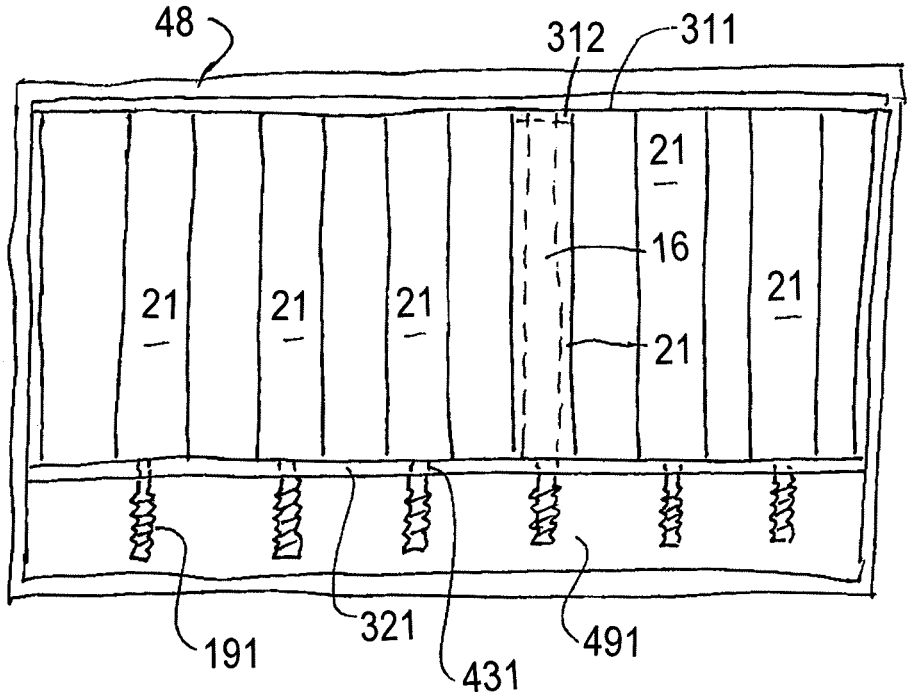
FIG. 7

MANUFACTURE OF SACRIFICIAL ANODES

This invention relates to a method for manufacture of sacrificial anodes for use in an ionically conductive medium which contains metal requiring cathodic protection and to an anode assembly so manufactured.

BACKGROUND OF THE INVENTION

In published US application US2016/0153096 published Jun. 2, 2016 by David Whitmore and in PCT Published Application WO94/29496 of Aston Material Services Limited is disclosed a method for cathodically protecting reinforcing members in concrete using a sacrificial anode such as zinc or zinc alloy. In this published application and in the commercially available product arising from the application there is provided a puck-shaped anode body which has a coupling wire attached thereto. In the commercially available products manufactured in accordance with this disclosure there are in fact two such wires arranged diametrically opposed on the puck and extending outwardly therefrom as a flexible connection wire for attachment to an exposed steel reinforcement member. This arrangement is shown in U.S. Pat. No. 6,193,857 (Davison) issued Feb. 27, 2001 and assigned to Foseco International. A similar arrangement is shown schematically also in U.S. Pat. No. 6,165,346 (Whitmore) issued Dec. 26, 2000. The disclosures of the above cited documents are incorporated herein by reference. In the above published US application is disclosed a method for installing the anodes by connecting the conductive wire from the cast zinc anode to one or more reinforcing bars within the concrete to be protected.

SUMMARY OF THE INVENTION

According to the invention there is provided a method for forming sacrificial anodes for installation in an ionically conductive medium at an installation site which medium contains metal requiring cathodic protection comprising:

locating in a receptacle a plurality of anode cores in an array in the receptacle, each anode core having a body of a sacrificial material and at least one electrical connector for connection to the metal;

providing in the receptacle dividing members defining a plurality of chambers each chamber containing a respective one of the anode cores;

and casting into the receptacle a covering material such that the covering material is in contact with at least a portion of each anode core and leaving at least a portion of the electrical connector exposed.

According to a second aspect of the invention there is provided a method for installing sacrificial anodes in an ionically conductive medium at an installation site which medium contains metal requiring cathodic protection comprising:

providing a receptacle having dividing members defining a plurality of chambers in an array;

each chamber containing a respective one of a plurality of anodes;

each anode comprising an anode core having a body of a sacrificial material and at least one electrical connector for connection to the metal;

each anode having a covering material cast in contact with at least a portion of the anode core with at least a portion of the electrical connector exposed;

wherein the anodes are transported in the receptacle to the installation site;

and at the installation site removing the anodes from the receptacle and inserting the anodes individually into the medium.

According to a third aspect of the invention there is provided an anode assembly comprising:

a plurality of sacrificial anodes for installing in an ionically conductive medium at an installation site which medium contains metal requiring cathodic protection:

providing a transportation receptacle having dividing members defining a plurality of chambers in an array;

each chamber containing a respective one of a plurality of anodes;

each anode comprising an anode core having a body of a sacrificial material and at least one electrical connector for connection to the metal;

each anode having a covering material cast in contact with at least a portion of the anode core with at least a portion of the electrical connector exposed; wherein the anodes are arranged to be removed from the receptacle at the installation site and inserted individually into the medium.

The electrical connector provides a metal connecting element which can be engaged with the metal within the medium. This can in some cases be formed by a deformable wire or wires which extend from the anode core and can be deformed by the installer to wrap around a portion of the metal. In other cases, the metal connecting element can be arranged so that it is clamped into place for example as a part of a screw coupling. Thus, the metal connecting element can be deformable or rigid and may or may not include other connecting components.

In some cases, it may be preferable that the electrical connector is a threaded stud, a pin or a plate. The stud, pin or plate may extend through a hole in a wall of the chamber or may bear on the upper edge of the chamber to support the anode core.

During the casting process, the anode cores are preferably engaged with the receptacle to hold them in place and also to restrict the cast covering material from engaging certain portions of the core as required. However other methods for locating the anode core in the receptacle can be used such as spacer members.

During the casting process, the cast material can become bonded to the walls of the receptacle and the preferred use of a flexible material to allow it to flex away from the cast material when the anode is removed can be used to enable demolding without special shaping of the receptacle.

Preferably the anodes are cast together as a group and are connected in the receptacle each to the next by a frangible bridge portion of the cast covering material. That is a portion of the cast material bridges over from one chamber to the next to hold the two side by side anodes connected with the bridge being broken at the installation site. This holds the anodes together as a structural body for transportation and assists in the manufacturing process as the cast material holds the structure together during the handling and packaging. However, the bridge is sufficiently thin to allow it to be broken without damaging the layer surrounding the core. The individual anodes can however be cast separately side by wide without any bridging component. Also in some cases the anodes can be cast separately and then laid side by side in the receptacle for the transportation. It will be appreciated that the covering material typically used is a mortar which is susceptible to damage if engaged with other hard components or other anodes so that the holding of the anodes in a specific position relative to one another can prevent this damage.

Thus, the frangible bridge portions are preferably broken and the anodes separated at the installation site. However, they may also be separated before shipping and shipped in the separated condition but side by side in the receptacle.

Preferably the anode cores are supported and located in the chambers by engagement of a wall portion of the receptacle with the wire. Thus, the wire exiting from the core body forms a suitable component to sit in a wall portion of the receptacle and hold the core spaced away from other walls of the receptacle for the cast material to properly surround at least some surface of the core as it is cast. In this arrangement, preferably the anode core has a wire extending outwardly from each end and the receptacle provides end wall portions engaging each wire of the anode core to support the anode core within its respective chamber suspended across the two end wall portions. This can be conveniently achieved by simply forming a slot in each end wall portion for receiving the respective wire. In this way, the core can be dropped into its chamber with the wires locating the core along the chamber. However other supports can be provided separate from the walls and the core can be supported by components at locations different from the wires.

Preferably the end wall portions of each chamber engage a respective end of the anode core and prevent the covering material engaging the wire as the covering material is cast. That is the length of the core is equal to the length of the chamber in which it is received so that the ends of the core are a sliding fit against the ends of the chamber. This seals off the penetration of the cast material into the area at the end of the core and keeps the material away from the wires which can cause problems during manufacture of the anode. Conveniently therefore the chambers are elongated and arranged side by side in a row. To form finger shaped anodes with a center core and a surrounding ring of the cast covering material. However other shapes and other arrangements of the array of chambers can be provided.

As the receptacle is typically disposable, it can preferably be formed of a flexible disposable plastic material molded to form the chambers and bendable to release the flexible material from the cast covering material. The cast covering material can therefore have tapered sides to allow the fingers to be pulled out, but because the material can be sufficiently flimsy the degree of taper may be reduced as the flexible material can be pulled away from the cast covering material during the one by one release of the anodes.

The arrangement herein is particularly advantageous where preferably the anodes are also transported in the same receptacle in which they are cast to the installation site where the installer can simply remove the anodes from the receptacle, while separating each from the next and can install them separately into the medium, typically concrete.

To provide even more effective packaging of a large supply of the anodes, preferably the receptacle forms a tray and the trays are stacked one on top of the next in at least one column. The tray thus has a base and upstanding molded walls into which the casting material is placed. However other shapes and configurations of the receptacle can be used. The column or columns can then be contained in an external container such as a cardboard box. A bottom wall of each tray onto which the material is cast acts for separating the anodes in the box from the anodes of the next tray to avoid frictional contact between the mortar layers which can damage the layers in transport. The amount of packaging material used is therefore reduced while providing a stable and effective transport system.

To obtain the best advantage, the method herein preferably uses the tray as both the receptacle for casting of a series of anodes side by side and the packaging in which the cast anodes are transported. However, it is also possible that the anodes can be cast separately and packaged at the casting site in trays side by side for the transport. Thus the anode can remain in the tray as it is transported, even if cracked or broken. It is also possible that the anodes are removed from the receptacle before transportation and transported as a group to the installation site in another packaging arrangement.

It is also possible that the common casting receptacle is used at the casting site and then the anodes removed at that location for transportation in a conventional packaging system different from the tray.

BRIEF DESCRIPTION OF THE DRAWINGS

One embodiment of the invention will now be described in conjunction with the accompanying drawings in which:

FIG. 5 is a top plan view of a package containing the anode assembly of the present invention.

FIG. 7 is a top plan view similar to FIG. 5 of a further embodiment of package containing the anode assembly of the present invention.

In the drawings like characters of reference indicate corresponding parts in the different figures.

DETAILED DESCRIPTION

Figure 1:
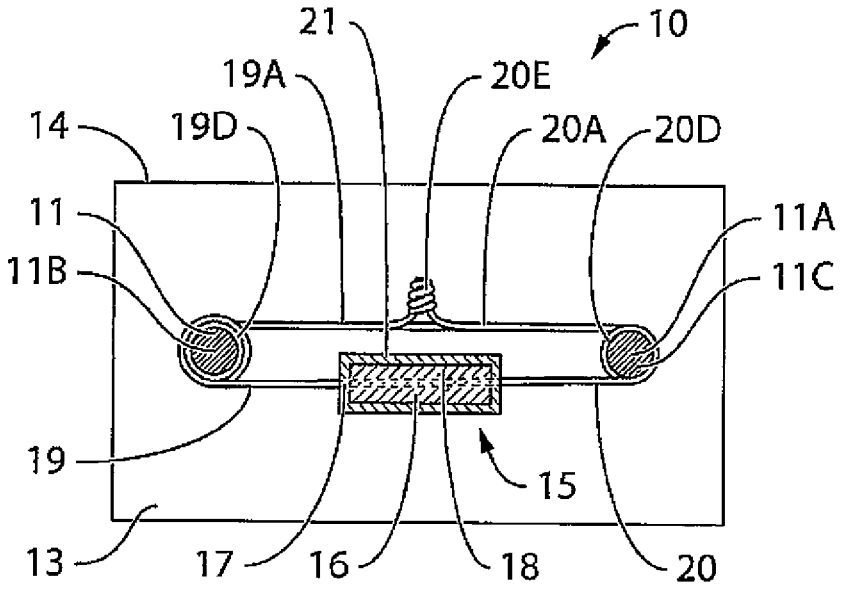
FIG. 1 is a cross-sectional view showing schematically a method according to the present invention for cathodic protection of steel members in concrete or mortar using an anode member having a sacrificial anode body attached by wires to the reinforcing steel members.

In FIG. 1 is shown a first embodiment according to the present invention of an improved cathodic protection device. The anode structure used is of a similar construction to that shown in the above application WO94/29496 and in U.S. Pat. Nos. 6,193,857 and 6,165,346, the disclosures of which are incorporated herein by reference or may be referenced for further detail.

Thus, the cathodic protection device is arranged for use in a concrete structure generally indicated at 10 having reinforcing bars 11, 11A embedded within the concrete 13 and spaced from an upper surface 14 of the concrete.

Embedded within the concrete at a position adjacent to the reinforcing bar 11 is a cathodic protection device generally indicated at 15 which includes an anode body 16.

At opposed end positions on the peripheral surface 17 is attached a pair of connecting wires 19 and 20 which are flexible but sufficiently stiff to be self-supporting. Any suitable electrically conductive material such as copper, titanium or steel can be used.

Around the anode body is provided a layer of a mortar material 21. In practice, the mortar material is moulded around the anode core to provide a thickness of a mortar material around the full periphery apart from the ends with the thickness being of the order of 1 cm. The wires 19 and 20 pass through the anode core and then the mortar is cast in place. The mortar forms an electrolyte which is in intimate communication with the concrete layer so that a current can flow from the anode to the steel reinforcement 11.

The mortar material is preferably a solid so that it can contain and hold the anode without danger of being displaced during the process. However, gels and pastes can also be used. The mortar material preferably is relatively porous so that it can accommodate expansion of the zinc oxide during consumption of the anode. However, voids which might fill with water should be avoided.

The use of the protection device is substantially as described in the above application WO94/29496 in that it is buried in the concrete layer either at formation of the concrete in the original casting process or more preferably in a restoration process subsequent to the original casting. Thus sufficient of the original concrete is excavated to allow the reinforcing bar 11 to be exposed. The wires 19 and 20 are then wrapped around the reinforcing bar and the protective device placed into position in the exposed opening. The device is then covered by a recast portion of concrete and remains in place buried within the concrete.

This system is therefore only applicable to a sacrificial anode system where the anode is buried within the concrete.

The cathodic protection device therefore operates in the conventional manner in that electrolytic potential difference between the anode and the steel reinforcing member causes a current to flow therebetween sufficient to prevent or at least reduce corrosion of the steel reinforcing bar.

The anode and preferably the covering 21 preferably includes at least one activator such as a high pH and/or a humectant material at the sacrificial anode for ensuring continued corrosion of the anode. Suitable materials are disclosed in the above cited documents.

The level of the pH and the presence of the humectant enhances the maintenance of the current so that the current can be maintained for an extended period of time in a range 5 to 20 years.

The method thus includes locating the sacrificial anode 16 which is of a material which is less noble than the steel members 11 in contact with the ionically conductive concrete or mortar material and providing an electrically conductive connection 19, 20 between the sacrificial anode and the steel section to form a circuit with communication of ions between the sacrificial anode and the steel section through the ionically conductive concrete or mortar material so that the sacrificial anode acts to provide cathodic protection of the steel section.

Figure 2:
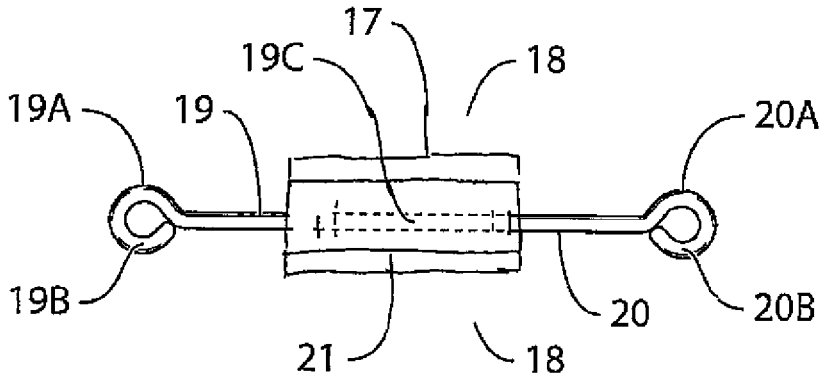
FIG. 2 is a top plan view of the anode member of FIG. 1 prior to attachment.

The first and second wires 19, 20 each extend from the sacrificial anode core 15 to a free end 19A, 20A remote from the anode. As shown in FIG. 2, the first and second wires are shaped to define a loop 19B, 20B at each of the first and second free ends by turning back the end. However, this is provided merely to assist in manual handling of the end and the ends can be simple terminations shown in FIG. 1.

Typically, the first and second wires form portions of a common wire 19C extending through the anode material 16 which has a core cast onto the common wire. This method of manufacture is very simple and provides an excellent connection both structurally and electrically between the wire and the sacrificial anode material.

Figure 3:
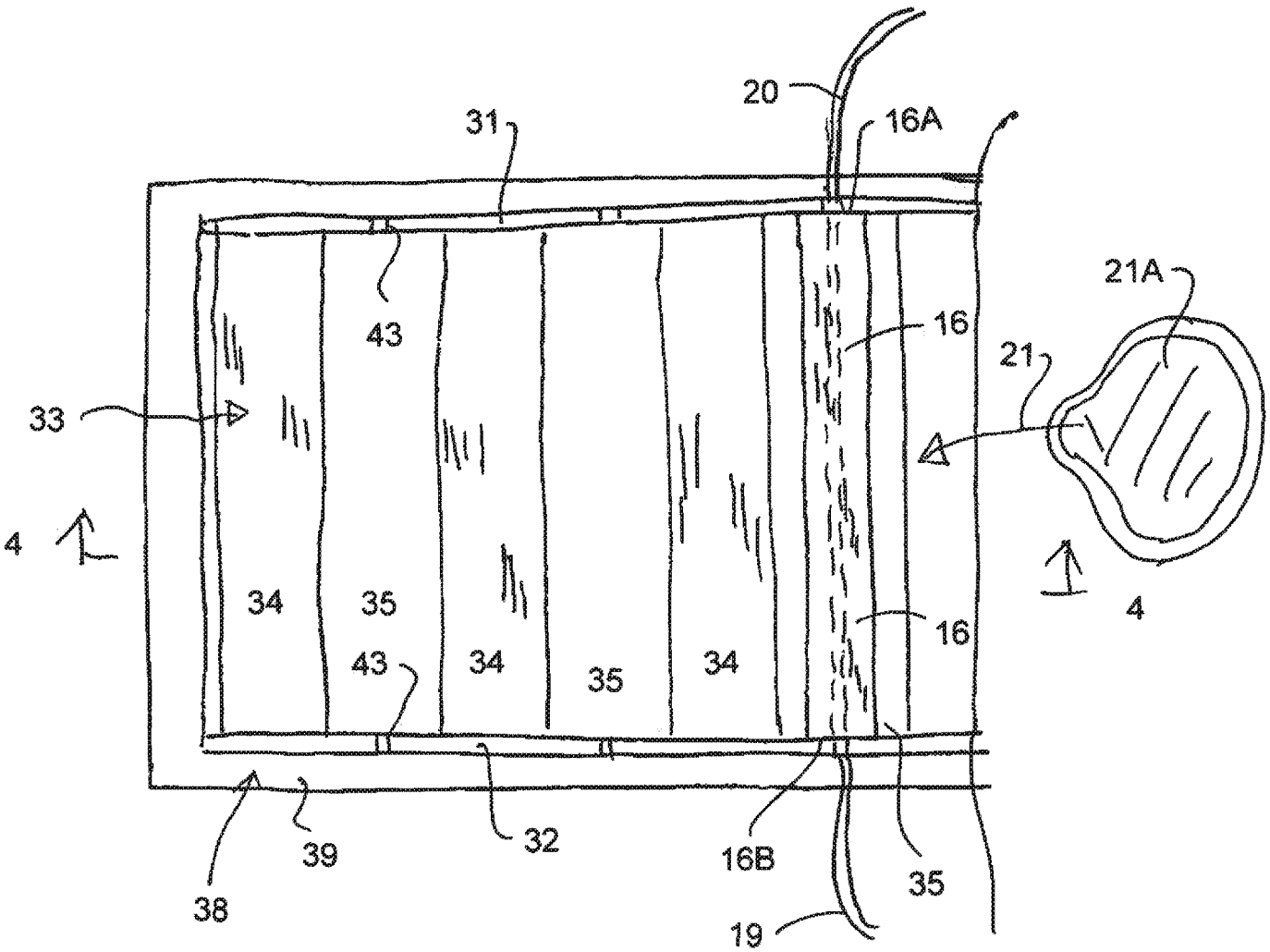
FIG. 3 is a top plan view of a method for casting the anode assembly of the present invention.
Figure 4:
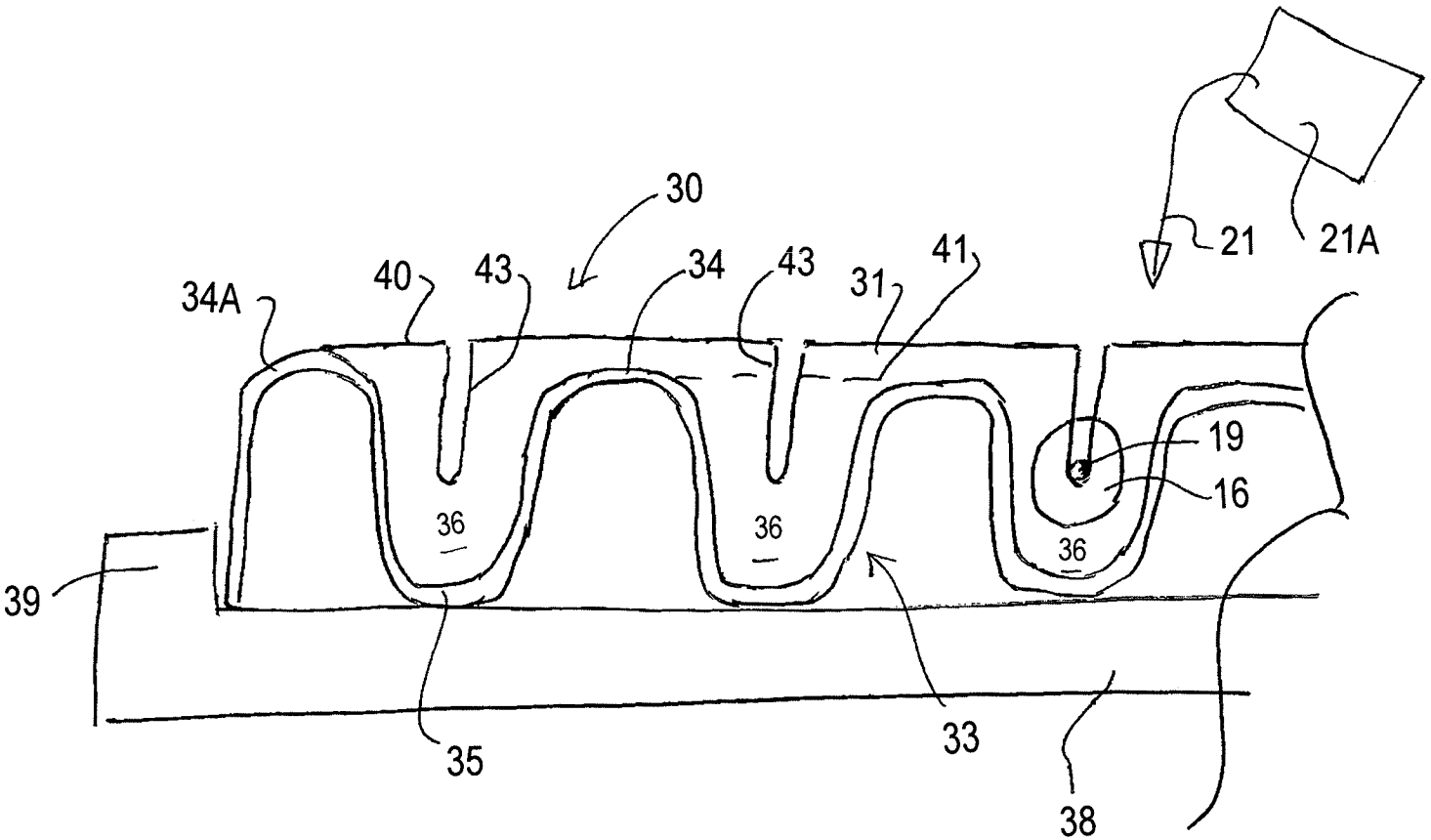
FIG. 4 is a cross-sectional view along the lines 4-4 of FIG. 3.

Turning now to FIGS. 3, 4 and 5 there is shown a method for forming the anode described above and for transporting the anode assembly to the installation site shown in FIGS. 1 and 2.

In FIGS. 3 and 4 is shown a receptacle 30 which is molded from a thin flexible plastics material to form end walls 31 and 32 and a main body 33. The main body is molded to form a generally undulating shape with raised ribs 34 and valleys 35. The valleys form chambers 36 for molding the anodes described above. The ribs 34 form spacers for holding each anode spaced from the next.

Thus, the method forms a plurality of sacrificial anodes for installing in the ionically conductive medium or concrete 13 at an installation site 10.

The receptacle or tray 30 forms both a casting tray and a transportation receptacle. The ribs 34 and end walls 31, 32 act as dividing members defining a plurality of chambers 36 in an array in the tray. These are elongated and side by side to form elongate rod-shaped anodes, but of course alternative shapes and spacings are possible. Each chamber 26 is arranged to act as a mold for and to contain a respective one of a plurality of the anodes side by side.

Each anode as set out above comprises the anode core 16 forming a body of a sacrificial material and a connecting wire 19 which passes through the core and forms two exposed end portions 19 and 20.

As shown in FIGS. 3 and 4 at the manufacturing location, the anode cores and wires are inserted into the respective chambers 36 and each anode has a cast covering material 21 for the anode cores with each anode core 16 having a coating of the covering material 21 at least partly surrounding the anode core 16 surrounding the outer surface but with the connecting wire 19 exposed at the ends.

At the manufacturing location, therefore the material 21 in a supply 21A is poured onto the tray to enter the chambers 36 and surround the core 16. While the casting action occurs, the tray is set on a pad 38 with a raised peripheral rib 39 containing the tray to support the tray sufficiently to receive the casting material. When the cast material is set, the tray is transported containing the series of anodes in a row to the installation site where the anodes are removed from the receptacle at the installation site and inserted individually into the concrete 13.

Figure 6:
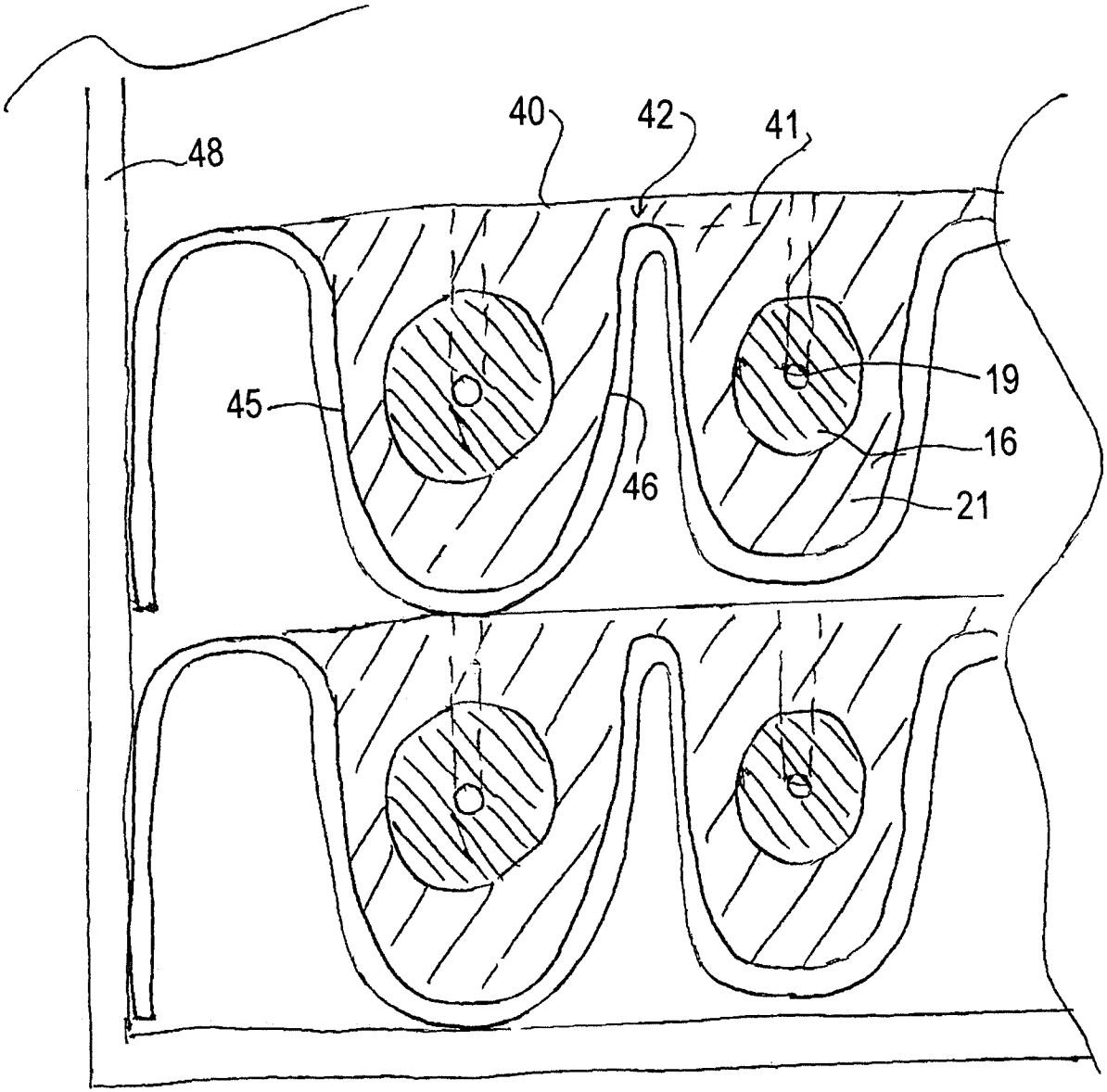
FIG. 6 is a cross-sectional view along the lines 6-7 of FIG. 5.

As shown in FIGS. 4 and 6, it will be noted that the end walls 31 and 32 and the end ribs 34A are raised to a top edge 40 higher than the top edge 41 of the intervening ribs 34. When the cast material is filled in the tray up to the line 40, this forms a portion of the cast material so that the anodes are connected in the receptacle each to the next by a frangible bridge portion 42 of the cast covering material 21. That is a portion of the cast material bridges over the rib 34 from one chamber 36 to the next to hold the two side by side anodes connected.

As the structure while remaining intact is transported in the tray from the manufacturing site to the installation site, the bridge portion 42 is broken at the installation site as the installer separates each anode in turn from the series of anodes supplied. This bridge 42 holds the anodes together as a structural body for transportation and assists in the casting process as the cast material holds the structure together during handling, packaging and transporting. However, the bridge 32 is sufficiently thin to allow it to be broken without damaging the layer 21 surrounding the core 16.

As shown best in FIG. 4, during the casting process the anode cores are supported and located in the chambers by engagement of the end walls 31, 32 of the tray 30 with the wire 19. Thus, the walls 31 and 32 each have a slot 43 extending downwardly from the top edge 40 to a bottom end of the slot adjacent a center of the chamber 36. The wire 19 exiting from the core body 16 sits in the slot 43 of the wall 31, 32 of the receptacle 30 and holds the core 16 as shown at the right in FIG. 3 spaced away from other walls of the chamber 36 for the cast material 21 to properly surround at least some surface of the core as it is cast from the supply 21A. In this way, the two end wall portions 31 and 32 engaging the ends 16A and 16B of the core 16 act to support each wire 19 of the anode core 16 to support the anode core within its respective chamber 36 suspended across the two end wall portions 31, 32. In this way the core can be dropped into its chamber with the wires locating the core along the chamber.

As shown in FIG. 3, the end walls 31 and 32 directly engage or butt against the end 16A, 16B of the anode core 16 so that as the material 21 is cast it cannot enter this area or is at least restricted from entering this area and thus prevents or restricts the covering material from reaching the wire 19. The chambers 36 are elongate and arranged side by side in a row to form finger shaped anodes with a center core and a surrounding ring of the cast covering material.

As the receptacle is supported during the casting process on the support pad 38, it is formed of a flexible disposable plastics material which can be molded to form the chambers and is simply bendable to pull away from the cast material to release the flexible material from the cast covering material. The walls of the ribs 34 of the main body 33 as shown at 45 and 46 have tapered sides to allow the anodes to be pulled out. However, since the flexible material can be sufficiently flimsy the degree of taper may be reduced relative to those used in conventional rigid molds as the flexible material can be pulled away from the casting during the extraction of the anodes.

As shown in FIGS. 5 and 6 the receptacle forms a tray and the trays are stacked one on top of the next in at least one column. The tray thus has a base and upstanding molded walls into which the casting material is placed. However other shapes and configurations of the receptacle can be used. The column or columns can then be contained in an external container 48 such as a cardboard box. A bottom wall of each tray onto which the material is cast acts for separating the anodes in the tray from the anodes of the next tray below to avoid frictional contact between the mortar layers which can damage the layers in transport. The amount of packaging material used is therefore reduced while providing a stable and effective transport system. The wires 19 and 20 are contained within an area 49 of the box 48 beyond the end walls 32, 32 where the wires can be bent, wrapped or folded to reduce the space required in that area. On arrival at the installation site, the individual anodes are pulled out of the chambers 36 with the respective wires being extracted from the storage areas 49.

In FIG. 7 is shown a plan view of an alternative arrangement where the anode bodies 16 use a single threaded rod, or other similar mechanism, for fastening to the metal. In this embodiment, the rod 191 is located only at one end of the anode body 16. In this arrangement, therefore there is only a single chamber 491 at the end of the box 48 to receive the rods 191. The rods thus are mounted in the casting process by passing the rod through a hole 431 in the end wall 321. As this engagement is relatively tight and the other end of the body 16 tightly engages the wall 311, this mounting can operate to hold the bodies 16 in place. However, a rib 312 can be provided in the wall 311 facing the end of the body 16 to assist in ensuring the proper location of the body 16 within the chamber for receiving the casting material in the casting process.

The invention claimed is:

1. An anode assembly comprising:

a plurality of sacrificial anodes for installing at an installation site in an ionically conductive medium containing metal requiring cathodic protection:

a transportation receptacle having dividing members defining a plurality of chambers;

each chamber containing a respective one of a plurality of the sacrificial anodes;

each of the sacrificial anodes having an anode body of a sacrificial material and at least one component in contact with said anode body for use in making an electrical connection between the anode body and the metal;

each of the sacrificial anodes having a cast covering material in contact with at least a portion of the anode body;

wherein each of the sacrificial anodes is ace arranged to be inserted individually into the medium;

and wherein the receptacle is formed of a flexible material shaped to form the chambers and the flexible material is bendable to release the flexible material from the cast covering material of each of the sacrificial anodes.

2. The assembly according to claim 1 wherein the sacrificial anodes are connected in the receptacle each to the next by a frangible bridge portion of the cast covering material.

3. The assembly according to claim 1 wherein said at least one component for use in making an electrical connection between the anode body and the metal extends outwardly from the anode body and wherein the anode bodies are supported and located in the chambers by engagement of a wall portion of the receptacle with said at least one component for use in making an electrical connection between the anode body and the metal.

4. The assembly according to claim 1 wherein said at least one component for use in making an electrical connection between the anode body and the metal comprises a pair of wires with each wire extending outwardly from a respective end of the anode body and the receptacle provides end wall portions engaging each wire of the pair of wires to support the anode body within its respective chamber.

5. The assembly according to claim 1 wherein a wall portion of each chamber engages a surface of the respective anode body at said at least one component for use in making an electrical connection between the anode body and the metal and prevents the covering material from engaging said at least one component for use in making an electrical connection between the anode body and the metal at said surface.

6. The assembly according to claim 1 wherein the chambers are elongate and arranged side by side in a row.

7. The assembly according to claim 1 wherein said receptacle forms one of a plurality of the receptacles with each receptacle forming a tray with the plurality of trays being stacked one on top of another in at least one column of the stacked trays and wherein there is provided an external container enclosing said at least one column of the stacked trays.

8. The assembly according to claim 1 wherein each of the anode bodies is elongate with a peripheral surface and two ends and arranged side by side in a row and wherein the covering material includes a tubular portion which surrounds the peripheral surface.

9. The assembly according to claim 8 wherein the sacrificial anodes are connected each to the next by a frangible bridge portion of the covering material which extends from the tubular portion of one sacrificial anode to the tubular portion of a next adjacent sacrificial anode.

10. The assembly according to claim 9 wherein the frangible bridge portion of the covering material forms a top layer of the covering material which extends only partly through a depth of the tubular portions.

11. The assembly according to claim 1 wherein the covering material includes a covering portion which substantially surrounds a peripheral surface of the anode body and wherein the sacrificial anodes are connected each to the next by a frangible bridge portion of the covering material which extends from the covering portion of one sacrificial anode to the covering portion of a next adjacent sacrificial anode.

12. The assembly according to claim 11 wherein the frangible bridge portion of the covering material forms a top layer of the covering material which extends only partly through a depth of the covering portions.

13. An anode assembly comprising:

a plurality of sacrificial anodes for installing at an installation site in an ionically conductive medium containing metal requiring cathodic protection:

a transportation receptacle having dividing members defining a plurality of chambers;

each chamber containing a respective one of a plurality of the sacrificial anodes;

each of the sacrificial anodes having an anode body of a sacrificial material and at least one component for use in making an electrical connection between the anode body and the metal;

each of the sacrificial anodes having a cast covering material in contact with at least a portion of the anode body;

wherein each of the sacrificial anodes is arranged to be inserted individually into the medium;

wherein at least one of the sacrificial anodes in its respective receptacle is connected to a next one of the sacrificial anodes in its respective receptacle by a frangible bridge portion of the cast covering material.

14. The assembly according to claim 13 wherein said at least one component for use in making an electrical connection between the anode body and the metal extends outwardly from the anode body and wherein the anode bodies are supported and located in the chambers by engagement of a wall portion of the receptacle with said at least one component for use in making an electrical connection between the anode body and the metal.

15. The assembly according to claim 13 wherein said at least one component for use in making an electrical connection between the anode body and the metal comprises a pair of wires with each wire extending outwardly from a respective end of the anode body and the receptacle provides end wall portions engaging each wire of the pair of wires to support the anode body within its respective chamber.

16. The assembly according to claim 13 wherein a wall portion of each chamber engages a surface of the respective anode body at said at least one component for use in making an electrical connection between the anode body and the metal and prevents the covering material from engaging said at least one component for use in making an electrical connection between the anode body and the metal at said surface.

17. The assembly according to claim 13 wherein the chambers are elongate and arranged side by side in a row.

18. The assembly according to claim 13 wherein said receptacle forms one of a plurality of the receptacles with each receptacle forming a tray with the plurality of trays being stacked one on top of another in at least one column of the stacked trays and wherein there is provided an external container enclosing said at least one column of the stacked trays.

19. The assembly according to claim 13 wherein each of the anode bodies is elongate with a peripheral surface and two ends and arranged side by side in a row and wherein the covering material includes a tubular portion which surrounds the peripheral surface.

20. An anode assembly comprising:

a plurality of sacrificial anodes for installing at an installation site in an ionically conductive medium containing metal requiring cathodic protection:

a transportation receptacle defining a plurality of chambers;

each chamber containing a respective one of a plurality of the sacrificial anodes;

each of the sacrificial anodes having an anode body of a sacrificial material and at least one component for use in making an electrical connection between the anode body and the metal;

each of the sacrificial anodes having a cast covering material in contact with at least a portion of the anode body;

wherein each of the sacrificial anodes is arranged to be inserted individually into the medium;

wherein the receptacle is formed of a material shaped to form for each chamber a base and upstanding dividing walls;

wherein the upstanding dividing walls include for each chamber four upstanding walls each on a respective side of the sacrificial anode contained therein;

and wherein each of the four upstanding side walls contacts at least part of the respective side and prevents contact of said at least a part of the respective side with a side of a next adjacent sacrificial body in a next adjacent chamber.

21. The assembly according to claim 20 wherein the receptacle is formed of a flexible material shaped to form the chambers and the flexible material is bendable to release the flexible material from the cast covering material of each of the sacrificial anodes.

22. The assembly according to claim 20 wherein the sacrificial anodes are connected in the receptacle each to the next by a frangible bridge portion of the cast covering material.

23. The assembly according to claim 20 wherein said at least one component for use in making an electrical connection between the anode body and the metal extends outwardly from the anode body and wherein the anode bodies are supported and located in the chambers by engagement of at least one portion of the upstanding diving walls with said at least one component for use in making an electrical connection between the anode body and the metal.

24. The assembly according to claim 20 wherein said at least one component for use in making an electrical connection between the anode body and the metal comprises a pair of wires with each wire extending outwardly from a respective end of the anode body and the said upstanding dividing walls providing wall portions engaging each wire of the pair of wires to support the anode body within its respective chamber.

25. The assembly according to claim 20 wherein at least one upstanding dividing wall of each chamber engages a surface of the respective anode body at said at least one component for use in making an electrical connection between the anode body and the metal and reduces the covering material from engaging said at least one component for use in making an electrical connection between the anode body and the metal at said surface.

26. The assembly according to claim 20 wherein the chambers are elongate and arranged side by side in a row.

27. The assembly according to claim 20 wherein said receptacle forms one of a plurality of the receptacles with each receptacle forming a tray with the plurality of trays being stacked one on top of another in at least one column of the stacked trays and wherein there is provided an external container enclosing said at least one column of the stacked trays.

28. The assembly according to claim 20 wherein each of the anode bodies is elongate with a peripheral surface and two ends and arranged side by side in a row and wherein the covering material includes a tubular portion which surrounds the peripheral surface.

29. An anode assembly comprising:

a plurality of sacrificial anodes for installing at an installation site in an ionically conductive medium containing metal requiring cathodic protection:

a transportation receptacle defining a plurality of chambers;

each chamber containing a respective one of a plurality of the sacrificial anodes;

each of the sacrificial anodes having an anode body of a sacrificial material and at least one component for use in making an electrical connection between the anode body and the metal;

each of the sacrificial anodes having a cast covering material in contact with at least a portion of the anode body;

wherein each of the sacrificial anodes is arranged to be inserted individually into the medium;

wherein the receptacle is formed of a material shaped to form for each chamber a base and upstanding dividing walls;

wherein the upstanding dividing walls include for each chamber upstanding walls fully surrounding the sacrificial anode contained therein.

30. The assembly according to claim 29 wherein the receptacle is formed of a flexible material shaped to form the chambers and the flexible material is bendable to release the flexible material from the cast covering material of each of the sacrificial anodes.

31. The assembly according to claim 29 wherein the sacrificial anodes are connected in the receptacle each to the next by a frangible bridge portion of the cast covering material.

32. The assembly according to claim 29 wherein said at least one component for use in making an electrical connection between the anode body and the metal extends outwardly from the anode body and wherein the anode bodies are supported and located in the chambers by engagement of at least one portion of the upstanding dividing walls with said at least one component for use in making an electrical connection between the anode body and the metal.

33. The assembly according to claim 29 wherein said at least one component for use in making an electrical connection between the anode body and the metal comprises a pair of wires with each wire extending outwardly from a respective end of the anode body and the said upstanding dividing walls providing wall portions engaging each wire of the pair of wires to support the anode body within its respective chamber.

34. The assembly according to claim 33 wherein at least one upstanding dividing wall of each chamber engages a surface of the respective anode body at said at least one component for use in making an electrical connection between the anode body and the metal and reduces the covering material from engaging said at least one component for use in making an electrical connection between the anode body and the metal at said surface.

35. The assembly according to claim 29 wherein the chambers are elongate and arranged side by side in a row.

36. The assembly according to claim 29 wherein said receptacle forms one of a plurality of the receptacles with each receptacle forming a tray with the plurality of trays being stacked one on top of another in at least one column of the stacked trays and wherein there is provided an external container enclosing said at least one column of the stacked trays.

37. The assembly according to claim 29 wherein each of the anode bodies is elongate with a peripheral surface and two ends and arranged side by side in a row and wherein the covering material includes a tubular portion which surrounds the peripheral surface.

* * * * *